US005228321A

United States Patent [19]

Shibasaka

[11] Patent Number: 5,228,321

[45] Date of Patent: Jul. 20, 1993

[54] METHOD OF CONFIGURING OPEN END OF CAN BODY

[75] Inventor: Mamoru Shibasaka, Yokohama, Japan

[73] Assignee: Toyo Seikan Kaisha, Limited, Tokyo, Japan

[21] Appl. No.: 902,733

[22] Filed: Jun. 23, 1992

[30] Foreign Application Priority Data

Jun. 26, 1991 [JP] Japan ..... 3-181744

[51] Int. Cl.[5] ..... B21D 19/12

[52] U.S. Cl. ..... 72/84; 72/96; 72/110

[58] Field of Search ..... 72/84, 96, 105, 110

[56] References Cited

U.S. PATENT DOCUMENTS 4,058,998 11/1977 Franek et al. ..... 72/84
4,070,888 1/1978 Gombas ..... 72/105
4,606,207 8/1986 Slade ..... 72/96
4,870,847 10/1989 Kitt ..... 72/84

*Primary Examiner*—Lowell A. Larson
*Attorney, Agent, or Firm*—Armstrong, Westerman, Hattori, McLeland & Naughton

[57] ABSTRACT

A necked-in and flange portion is formed in the open end of a seamless can body by using a can end holder driven for rotation about its axis, an axially movable inner roll of a reduced diameter disposed adjacent the can end holder, and a spinning roll positioned axially stationary outside the can body. While the can body with the open end telescoped onto the can end holder and in contact with the inner roll is rotated together with the can end holder, the spinning roll is advanced toward the can end holder and forced into the open end, and simultaneously the can body is moved in an axial direction away from the can end holder together with the inner roll, to form the necked-in and flange portion.

3 Claims, 11 Drawing Sheets

CAN FEED
CAN DISCHARGE
(mm)
ADVANCE
DWELL
RETRACT
POSITION OF SPINNING ROLL 4
6
0
0
90
180
270
360

(mm)
DWELL
ADVANCE
POSITION OF INNER ROLL 3
10.4
0

(mm)
ADVANCE
RETRACT
DWELL
RETRACT
POSITION OF CHUCK 7
67
0

(mm)
ADVANCE
RETRACT
DWELL
RETRACT
POSITION OF BOTTOM SUPORT PLATE 57
47
0

(mm)
RETRACT
DWELL
ADVANCE
POSITION OF BALL SCREW 29
22.9
0
ROTATION ANGLE (DEGREES)

METHOD OF CONFIGURING OPEN END OF CAN BODY

BACKGROUND OF THE INVENTION

The invention relates to a method of configuring an open end of a seamless or one-piece can body to be used for beverage cans, preserved food cans and so on, to form a necked-in and flange portion therein.

There is proposed a method of forming the necked-in portion and the flange portion simultaneously in the open end of the one-piece can body by a spinning method in U.S. Pat. Nos. 4,563,887 and 4,760,725.

The forming tool used in the prior art, is provided with a can end holder or collar driven for rotation about its axis, an anvil or sleeve and a spinning roll. The can end holder is resiliently biased toward the sleeve which is at an axially fixed position. The sleeve has a smaller diameter than that of the can end holder, and is orbited to its eccentric position so that it may be in contact with the inside wall of the open end while the open end is shaped.

The can body whose open end is forced onto the collar is rotated about its axis by the can end holder and a bottom chuck cooperating therewith.

While the spinning roll is radially forced into the open end against a V-shaped recess formed between the can end holder and the anvil, the open end is squeezed between the spinning roll and the anvil to form the necked-in portion, and the foremost end is pressed against the can end holder resiliently by the spinning roll which is moving toward the collar, to form the flange portion.

The prior method has disadvantages that the outer lacquer film on the configured portion is susceptible to damages such as peeling due to slippage between the open end and the spinning roll, and the shaped portion is liable to be reduced in its thickness to the extent that rupture might occur, owing to the squeezing and pressing, particularly when a relatively thin open end is spin-formed at a relatively high velocity, so as to reduce material and operation costs.

SUMMARY OF THE INVENTION

The purpose of the invention is to provide a method of imparting a necked-in and flange configuration to the open end of an one-piece can body by spinning, wherein the outer lacquer film on the configured portion is less liable to damage, and the shaped portion is hard to be reduced in its thickness, even when the open end is relatively thin and the forming speed is relatively high.

According to the invention, the open end of the one-piece can body is spin formed by using a can end holder driven for rotation about its axis, a freely rotatable and axially movable inner roll of a reduced diameter disposed adjacent the can end holder which inner roll can be orbited to its eccentric position to make contact with the inner surface of the open end, and a spinning roll positioned axially stationary outside the can body and capable of substantially radial movement toward and away from the open end in a controlled mode relative to the axial movement of the inner roll.

While the can body with the open end forced onto the tip of the can end holder is rotated about its axis together with the can end holder, the spinning roll is advanced toward the can end holder and forced into the open end, and simultaneously the can body is moved in an axial direction away from the can end holder together with the inner roll at a controlled speed relative to the movement of the spinning roll, to form the necked-in and flange portion in the open end.

The open end may be configured by forcing the spinning roll into the open end, simultaneously moving slightly the can end holder in an axial direction counter to the inner roll against a resilient force, while controlling the clearance between the truncated cone-shaped chamfer formed about the front rim of the can end holder and the truncated cone-shaped chamfer formed about the rear rim of the spinning roll, preferably by using a cam means.

Other features and advantages of the invention will be apparent from the following description and the accompanying drawings.

PREFERRED EMBODIMENTS OF THE INVENTION

Figure 1:
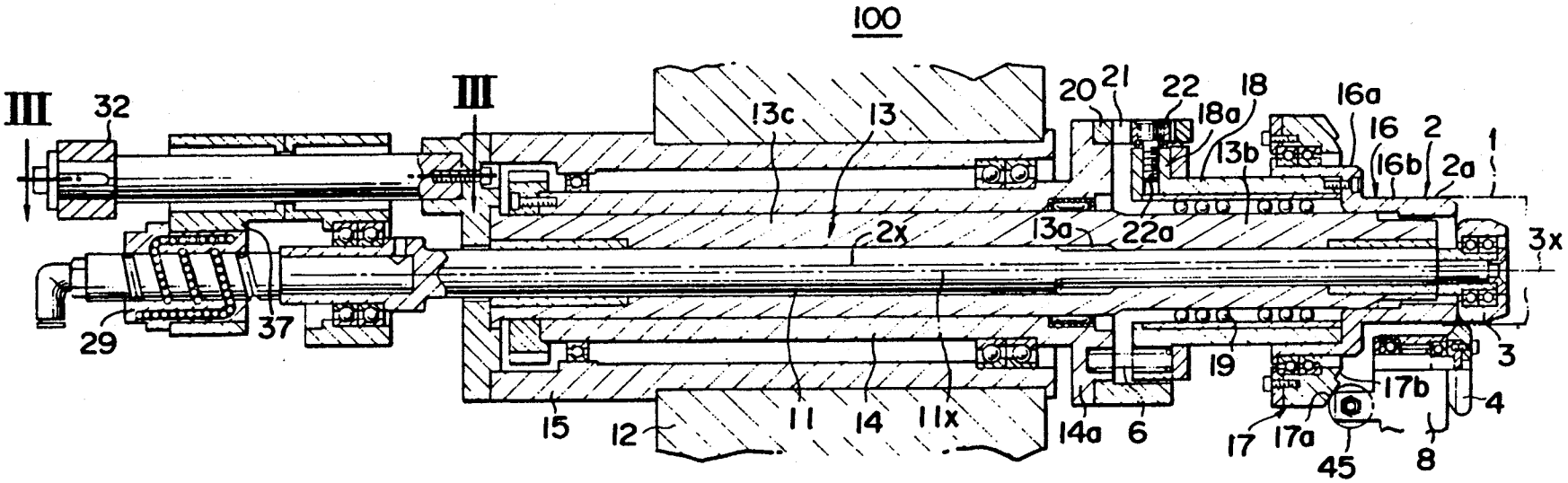
FIG. 1 is a longitudinal sectional view of a forming tool for practicing the invention.
Figure 2:
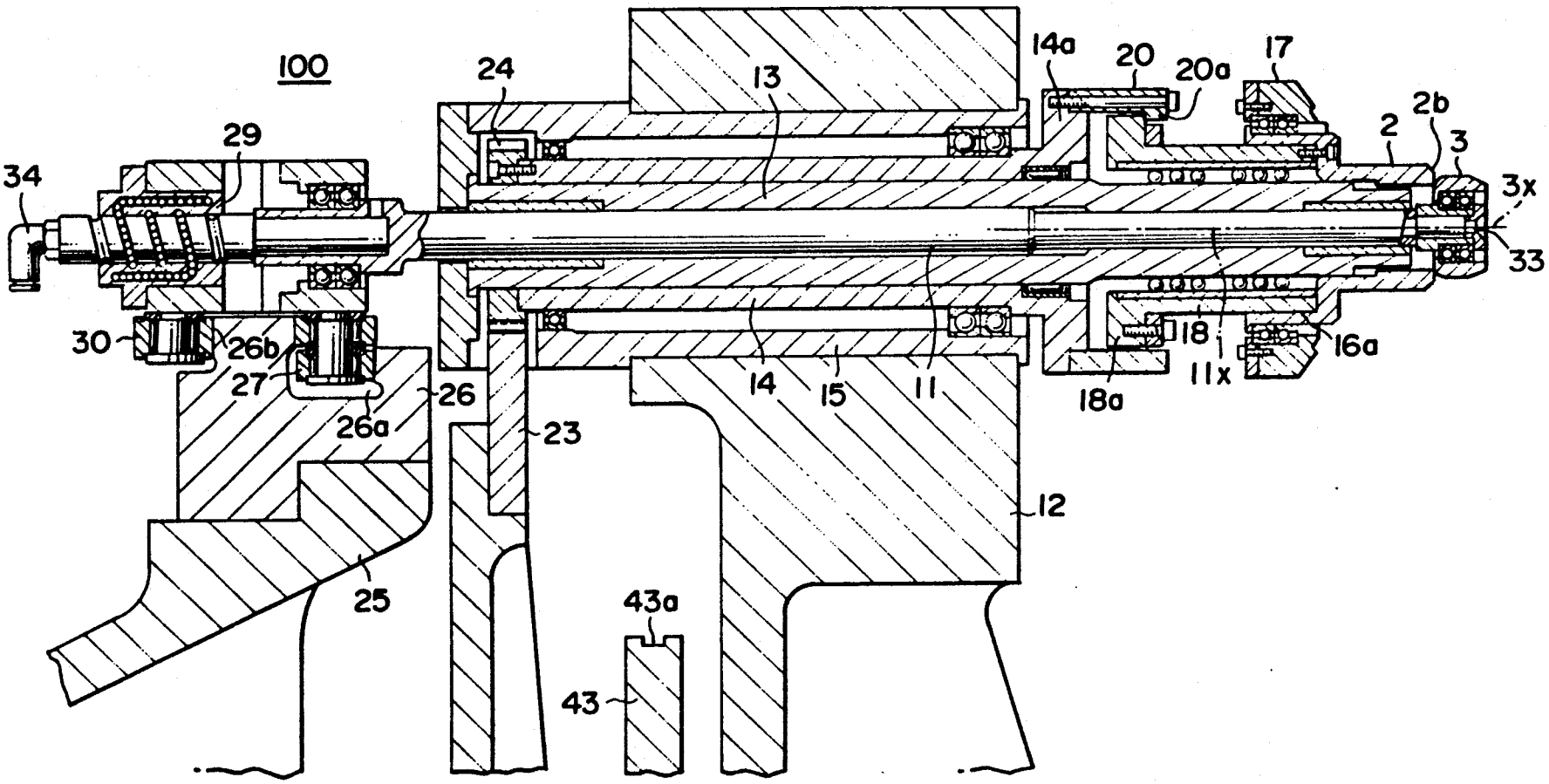
FIG. 2 is a longitudinal sectional view taken along a plane through the axis of the support shaft of the can end holder shown in FIG. 1 and the axis of a main drive shaft.

A plurality of (e.g. thirty) forming tool assemblies 100 indicated in FIGS. 1 and 2 are disposed with regularly spaced intervals along the periphery of a large wheel 12 fixed to a main drive shaft not shown.

The freely rotatable inner roll 3 is carried eccentrically and adjacent the can end holder 2 on the front end of a support shaft 11 in parallel with the main drive shaft, that is, such that its axis 3*x* is offset from the axis 11*x* of the support shaft 11. The support shaft 11 is axially slidable through a bore 13*a* formed eccentrically through a fixed sleeve 13. The inner roll 3 is formed with a curved chamfer 3b about its rear rim, as best shown in FIG. 8(*a*).

As shown in FIG. 1, when the inner roll 3 is at its eccentric position, and the circumferential surfaces of the inner roll 3 and the can end holder 2 are on a common phantom linear line in parallel with the axial direction and opposite to the spinning roll 4, the axis 3x, the axis 11x and the axis 2x of the can end holder 2 are located on a common plane through the above phantom linear line, and the axis 11x is positioned in the center of the axis 3x and the axis 2x.

The outer diameter of the front portion 13b of the sleeve 13 is smaller than that of the rear portion 13c thereof which passes through a rotatable hollow cylinder 14. The hollow cylinder 14 is mounted inside a bushing 15 which is secured to the wheel 12.

The can end holder 2, that is, the tip of a reduced diameter front portion 16b of a can support 16, is formed with a truncated cone-shaped chamfer 2b. The outer surface 2a of the can end holder 2 has a diameter, such that the open end 1a of an one piece can body 1 to be configured may be snugly telescoped thereonto.

A clearance control cam 17 which is provided with a two stage cam face consisting of truncated cone-shaped faces 17a and 17b on its front end, is carried on the large diameter rear portion 16a of the support 16, to be freely rotatable and axially stationary.

A cylinder block 18 fixed inside the rear portion 16a and having an outer flange 18a (refer to FIG. 2) is mounted rotatably and axially slidably on the front portion 13b of the sleeve 13 through a stroke bearing 19.

A plurality of springs 6 are disposed circumferentially between the flange portion 14a of the rotatable hollow cylinder 14 and the outer flange 18a of the cylinder block 18, so as to bias resiliently the cylinder block 18, i.e. the can support 16 forwardly, i.e. to the right as viewed in FIG. 1, such that normally the outer flange 18a is engaged with the inner protrusion 20a of the ring 20 fixed to the flange portion 14a, and the can support 16 is held axially stationary (refer to FIG. 2).

A roller 22 having a screw shaft 22a threadedly secured to the cylinder block 18 is inserted in a slot 21 formed in the ring 20 and having the width substantially equal to the diameter of the roller 22, such that the cylinder block 18, i.e. the can support 16 is rotated by the rotatable hollow cylinder 14 via the roller 22.

The hollow cylinder 14 is rotated by a sun gear 23 secured to the main drive shaft not shown and in mesh with a gear 24 fixed to the cylinder 14 (refer to FIG. 2).

A cam follower 27 provided on the rear portion of the support shaft 11 through a ball bearing 28 is engaged with a cam track 26a which is formed along the outer surface of a cam drum 26 secured to a stationary frame 25, such that the support shaft 11, i.e. the inner roll 3 reciprocates axially in a predetermined timing.

Figure 3:
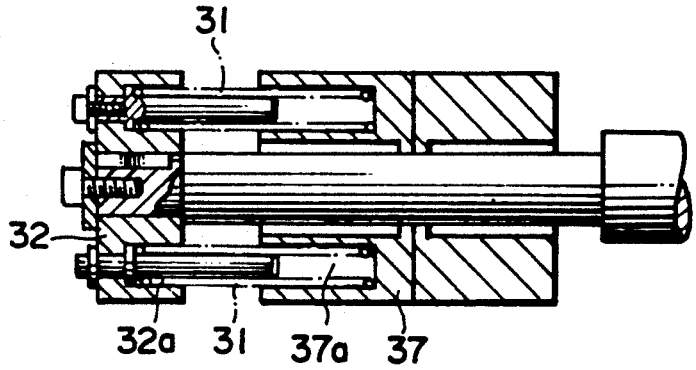
FIG. 3 is a longitudinal sectional view taken along line III—III in FIG. 1.

A ball screw assembly 29 provided with a cam follower 30 is also carried on the rear end of the support shaft 11. The cam follower 30 is engaged with a cam track 26b formed along the rear corner of the cam drum 26 under pressure by compression springs 31 via a tubular body 37 which spring 31 is disposed between the groove 32a of an axially stationary head 32 and the groove 37a of the tubular body 37 (refer to FIG. 3).

Figures 9A, 9B, 9C, 9D, 9E:
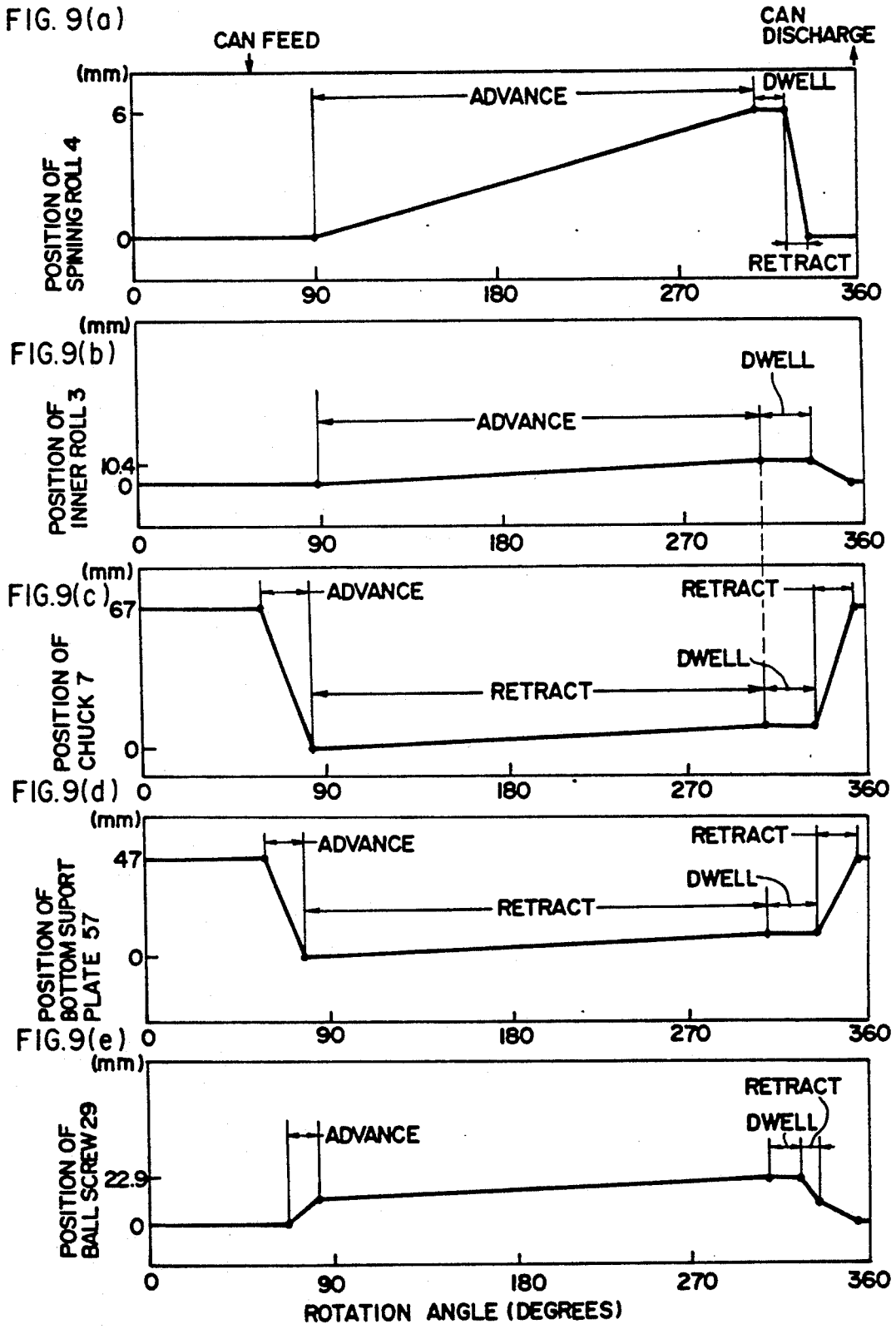
FIGS. 9 (*a*), (*b*), (*c*), (*d*) and (*e*) are diagrams showing an example of the relationship between the rotation angle of the forming tool assembly and the chuck assembly about its main drive shaft, and the positions of the spinning roll, the inner roll, the chuck, the bottom support plate and the ball screw assembly, respectively.

The contour of the cam track 26b is formed such that during an extremely short time when the support shaft 11, i.e. inner roll 3 has reached the most forward position and dwelled (refer to FIG. 9(*b*)), the cam follower 30 moves away from the cam follower 27 to retract the ball screw assembly 29 (refer to FIG. 9(*e*)), thereby to orbit the support shaft 11 by 180 degrees and allow the inner roll 3 and the can end holder 2 to be coaxial, and immediately before the support shaft 11 which has returned to the original position shown in FIG. 2 commences to advance, the ball screw assembly 29 together with the cam follower 30 approaches the cam follower 27, i.e. advances, and orbits the support shaft 11 by 180 degrees, so that the inner roll 3 may return to the original eccentric position (refer to FIG. 9(*b*), (*e*)). The support shaft 11 is formed with a through bore 33 which connects to a pressurized air supply not shown via a pipe 34.

Figure 4:
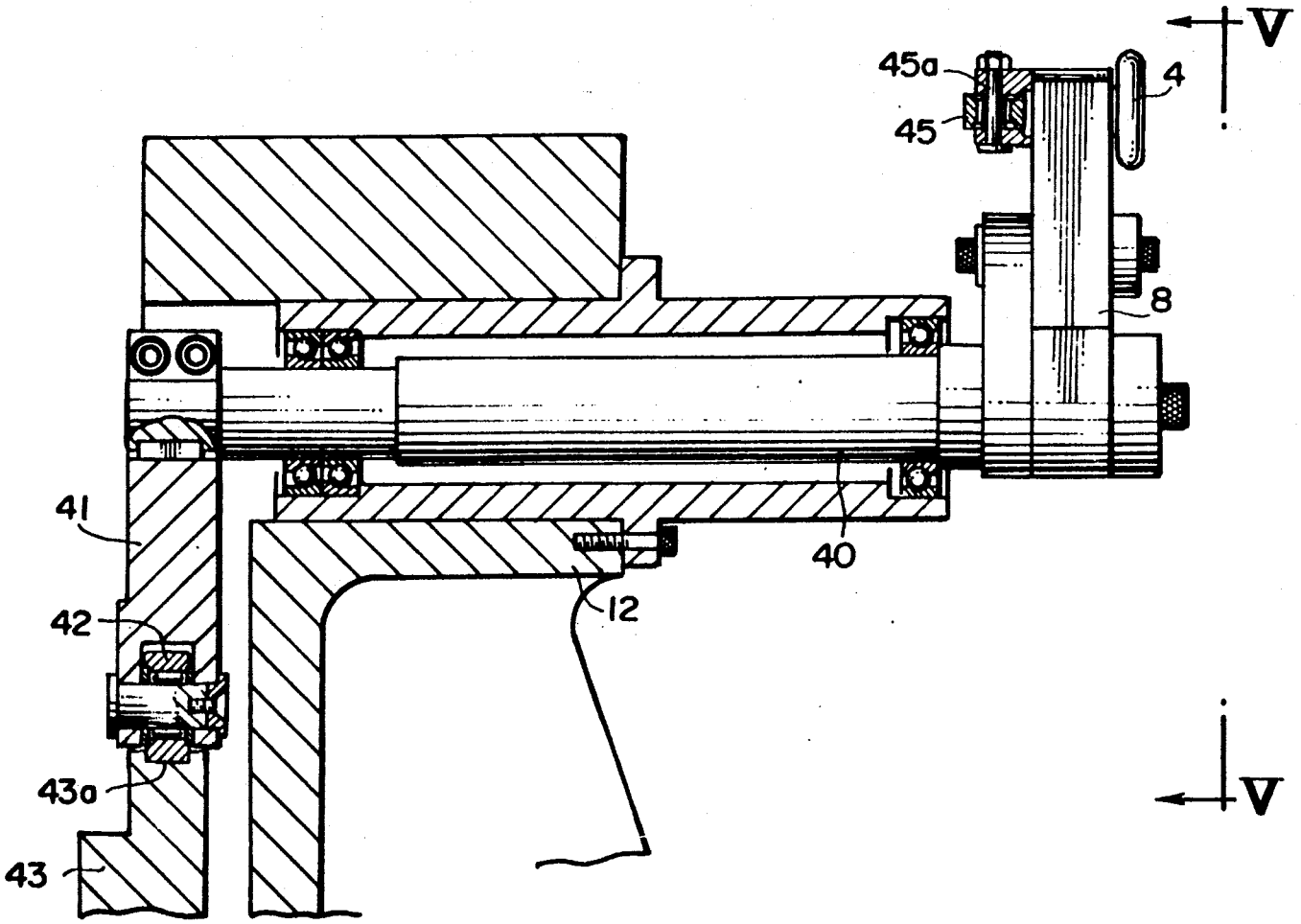
FIG. 4 is a fragmentary longitudinal view taken along a plane through the axis of the spinning roll indicated in FIG. 1 and the axis of the main drive shaft.

The spinning roll 4 is freely rotatably mounted on the holder 8 at its front side, which is fixed to the front end of a shaft 40 rotatably carried on the wheel 12, such that the spinning roll 4 is positioned axially stationary between and in proximity to the can end holder 2 and the inner roll 3, as illustrated in FIGS. 1 and 4.

The spinning roll 4 is formed with a truncated cone-shaped chamfer 4a extending about its rear rim and in parallel with the chamfer 2b, and a curved chamfer 4b about its front rim, as best shown in FIG. 8(*a*).

Figure 5:
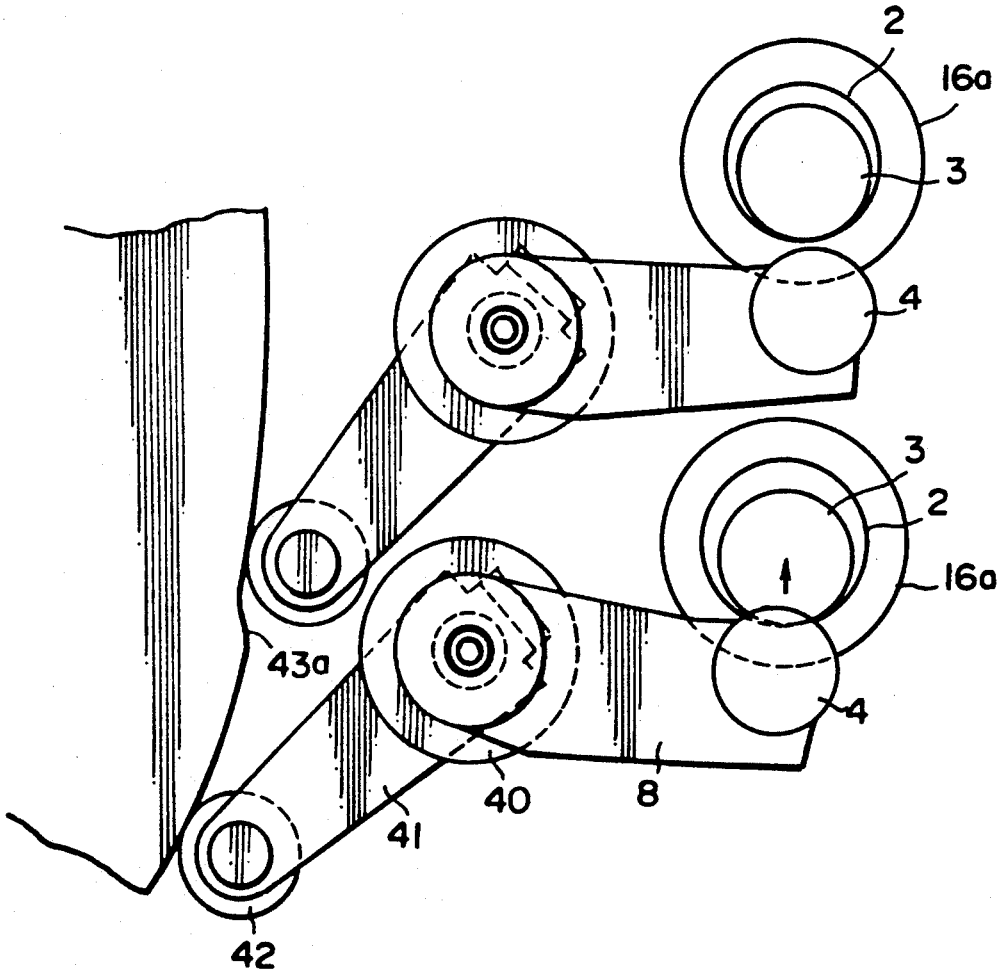
FIG. 5 is an explanatory side elevation viewed from line V—V in FIG. 4 for illustrating the fashion of the movement of the spinning roll.

A cam follower 42 attached to the tip of an arm 41 secured to the rear end of the shaft 40 is engaged with a cam track 43a formed along the peripheral face of a cam drum 43 (refer to FIGS. 2 and 4). The cam track 43a is adapted to oscillate the arm 41 at a predetermined timing in accordance to the rotation of the wheel 12, as indicated in FIG. 5, and thus to move the spinning roll 4 substantially radially toward and away from the can end holder 2 (refer to FIG. 9(*a*)). In FIG. 5, the upper portion and the lower portion indicate the states that the spinning roll 4 is at the position prior to the start of forming and at the position immediately after the end of forming, respectively.

A cam roller 45 freely rotatably mounted on a shaft 45a secured to the rear side of the holder 8 is adapted to control the clearance "k" (refer to FIG. 8(*b*)) between the chamfer 4a of the spinning roll 4 and the chamfer 2b of the can end holder 2, while the spinning roll 4 pushes the open end 1a of the can body 1, in cooperation with the clearance control cam 17.

While the cam roller 45 is engaged with the outer cam face 17a and the spinning roll 4 pushes the open end 1a, the control cam 17 and the can end holder 2 retract slightly against the force of the springs 6, and is formed a clearance "k" slightly larger than the thickness "t" of the open end 1a, e.g. the clearance "k" being 0.3 mm in the case of the thickness "t" of 0.2 mm.

While the cam roll 45 is engaged with the inner cam face 17b after the virtual middle of the push by the spinning roll 4, a set clearance "k", where the open end 1a is not present between the chamfers 2b and 4d, is slightly smaller than the thickness "t" of the open end 1a, e.g. the clearance "k" being 0.1 mm in the case of the thickness "t" of 0.2 mm. So as to set the clearance "k" to an adequate one, the shaft 45a of the cam roll 45 is adapted to be oscillated eccentrically.

Figure 6:
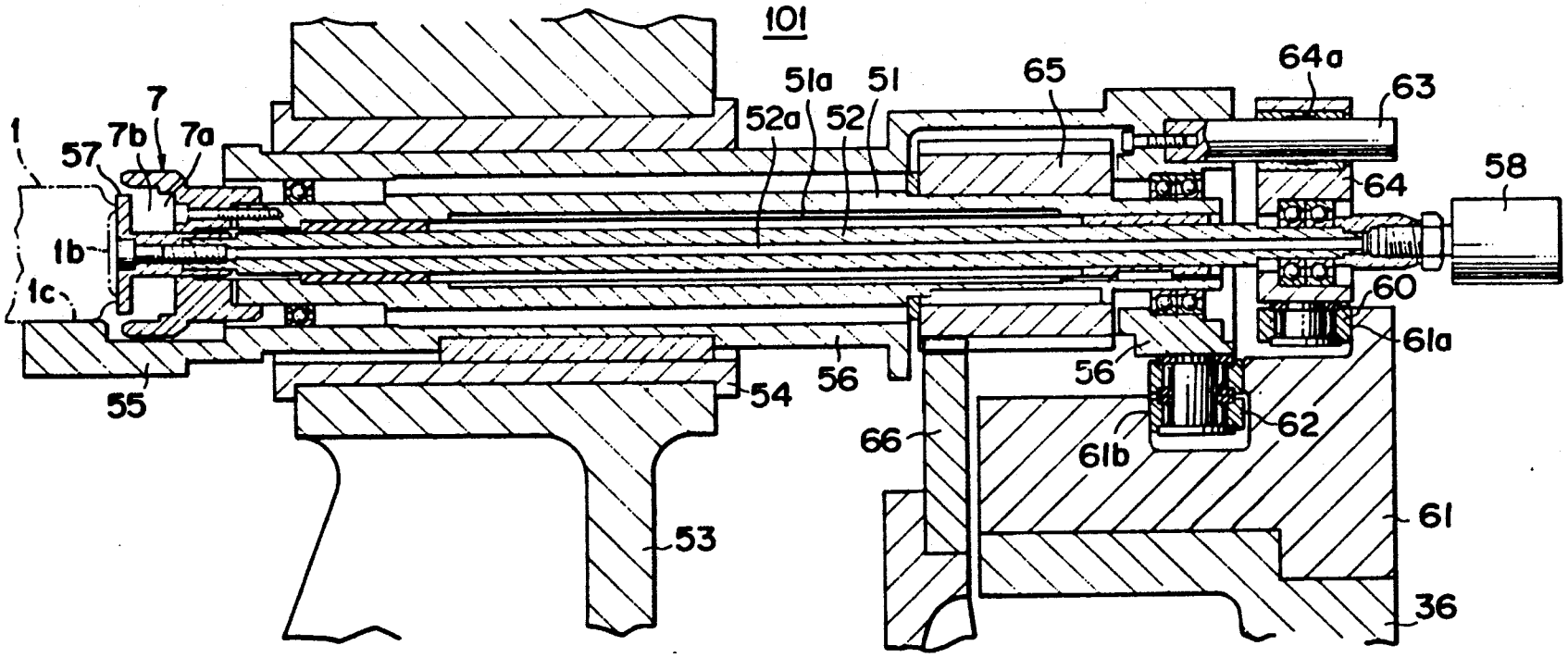
FIG. 6 is a longitudinal sectional view of a chuck assembly of the apparatus employed for practicing the invention.
Figure 7A:
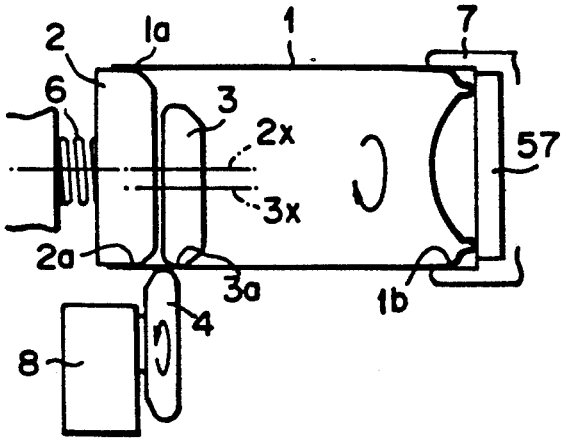
FIGS. 7 (*a*), (*b*), (*c*) and (*d*) are explanatory schematic views for showing typical successive stages of the operation according to the invention.
Figure 7B:
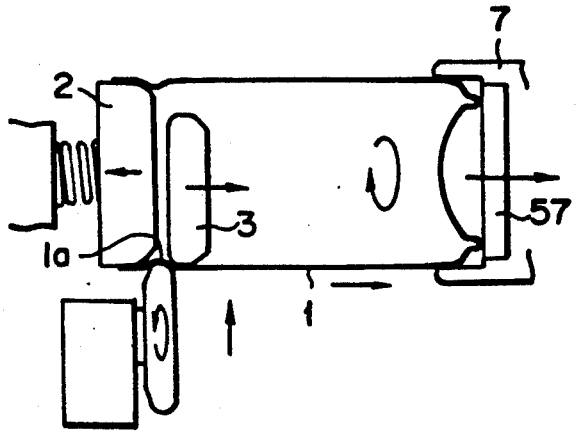
Figure 7C:
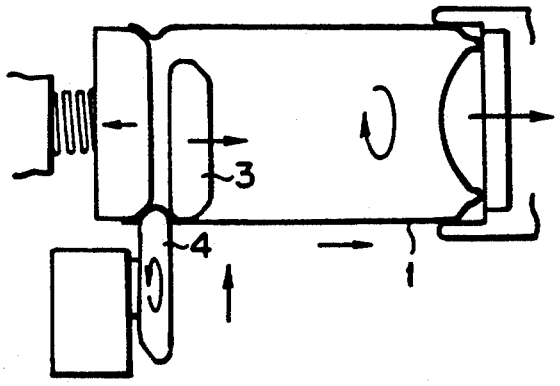
Figure 7D:
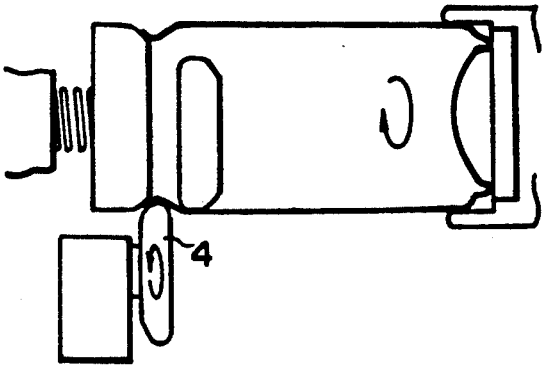
Figure 8A:
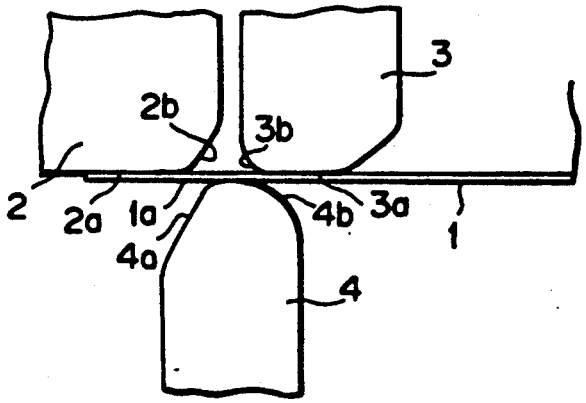
FIGS. 8 (*a*), (*b*), (*c*) and (*d*) are fragmentary views on an enlarged scale of FIGS. 7 (*a*), (*b*), (*c*) and (*d*), respectively.
Figure 8B:
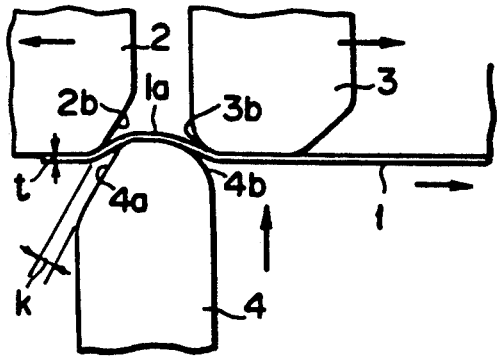
Figure 8C:
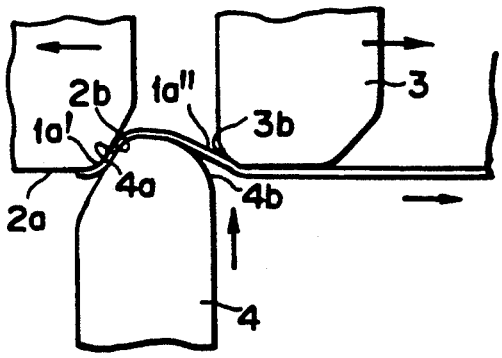
Figure 8D:
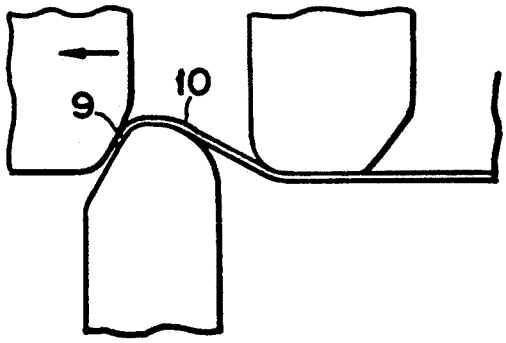

A chuck assembly 101 shown in FIG. 6 is disposed opposite to the forming tool assembly 100. The chuck assembly 101 is provided with a chuck 7 secured to the front end (left end as viewed in FIG. 6) of a chuck support cylinder 51 which is coaxial with the can end holder 2, a vacuum suction shaft 52 which is formed worth a through hole 52a and slidable along the center hole 51a of the chuck support cylinder 51, and a hollow cylindrical member 56 which is slidable along a bushing 54 secured to a large wheel 53 and carries a can body support 55 on its tip. The wheel 53 is fixed to the main drive shaft and adapted to rotate together with the wheel 12 shown in FIG. 1.

A bottom support plate 57 for the bottom 1*b* of the can body 1 is provided on the front end of the vacuum suction shaft 52. A lower recess 7*a* having a shape corresponding to the bottom support plate 57 and a upper recess 7*b* capable of receiving snugly the lower portion 1*c* of the sidewall of the can body 1 are formed inside the chuck 7, such that when the chuck support cylinder 51 advances, i.e. shifts to the left as viewed in FIG. 6, with the bottom support plate 57 virtually at an axially fixed position, the bottom support plate 57 comes into the lower recess 7*a*, and the can body 1 is held by the chuck 7 under a vacuum suction. The vacuum through hole 52*a* is connected to a vacuum pump not shown via a rotary union 58.

The vacuum suction shaft 52 is rotatably mounted in a block 64 to which a cam follower 60 is attached. The cam follower 60 is engaged with a cam track 61*a* of a cam drum 61 secured to a stationary frame 36. The cam track 61*a* is formed such that the bottom support plate 57 reciprocates axially between the position indicated in FIG. 6 and the position indicated in FIG. 7(*a*) where the open end 1*a* has been telescoped onto the can end holder 2, at a predetermined timing in accordance with the rotation of the wheel 53 (refer to FIG. 9(*d*)).

A cam follower 62 attached to the hollow cylindrical member 56 is engaged with a cam track 61*b*. The cam track 61*b* is formed such that the hollow cylindrical member 56, i.e. the chuck support cylinder 51 reciprocates axially at a predetermined timing in accordance with the rotation of the wheel 53, particularly while configuring the open end 1*a*, the chuck support cylinder 51, i.e. the chuck 7 retracts, i.e. shifts to the right as viewed in FIG. 6 at the same velocity as the advancing velocity of the inner roll 3 (refer to FIG. 9(*c*)).

A pin 63 secured to the cylindrical member 56 and slidable along a through hole 64*a* of the block 64 serves to hinder the block 64 from rotating. A gear 65 secured to the chuck support cylinder 51 and meshed with a sun gear 66 is adapted to rotate the chuck 7, such that the open end 1*a* of the can body held by the chuck 7 rotates at a substantially same circumferential velocity as the can end holder 2, that is, the can body 1 where the open end 1*a* is forced onto the holder 2 and the bottom 1*b* is held by the chuck 7, rotates about its axis without twisting.

The operation of the above-described apparatus is as follows. While the forming tool assembly 100 and the chuck assembly 101 opposite thereto and at the state shown in FIG. 6 are rotated about the main drive shaft, the can body 1 is fed from a feeding apparatus not shown and received on the can body support 55 (refer to FIG. 9(*a*)).

Immediately thereafter, the can body 1 is attached to the bottom support plate 57 at its bottom 1*b* by vacuum suction, and the bottom support plate 57, the chuck 7 and the can body support 55 advance, i.e. shift to the left as viewed in FIG. 6, accompanied by the forward movements of the vacuum suction shaft 52 and the chuck support cylinder 51 by means of the cam followers 60 and 62, thereby to force the open end 1*a* of the cam body 1 onto the can end holder 2 (refer to FIG. 9(*c*), (*d*)).

When the open end 1*a* has been telescoped onto the holder 2, the vacuum suction shaft 52 stops advancing. Since the chuck support cylinder 51 continues to advance, the bottom support plate 57 comes into the lower recess 7*a* and the can body 1 is held by the chuck 7.

At this time, the inner roll 3 has been orbited to its eccentric position indicated in FIGS. 1 and 7(*a*), that is, the axis 3*x* offsets from the axis 2*x* of the can holder 2, and the roll 3 comes into contact with the inside wall of the open end 1*a* at a narrow rim 3*a*. The spinning roll 4 is disposed slightly outside the can body 1.

In accordance with the rotation of the can body 1 about the drive shaft, the arm 41 attached with the cam follower 42 oscillates, and the spinning roll 4 advances virtually radially toward the can end holder 2, and comes into contact with the open end 1*a* at a rotation angle of, e.g. about 115 degree indicated in FIG. 9(*a*), as sown in FIGS. 7(*a*) and 8(*a*). Then the spinning roll 4 commences to be forced into, i.e. push the open end 1*a* of the can body 1 which is rotating about its own axis, as indicated in FIGS. 7(*b*) and 8(*b*).

With the advance of the spinning roll 4, the inner roll 3 and the chuck 7 shift to the right as viewed in FIG. 7, together with the can body 1 at the same velocity by means of the cam followers 27 and 62, thus to form the necked-in portion 10 and the flange portion 9 as illustrated in FIGS. 7(*c*), 7(*d*), 8(*c*) and 8(*d*). The bottom support plate 57 also shifts to the right at the same velocity as the chuck 7 by means of the cam follower 60.

Since until the substantial middle of the push, the cam roller 45 is engaged with the outer cam face 17*a* of the clearance control cam 17, the can end holder 2 shifts slightly to the left against the resilient force of the springs 6 as viewed in FIGS. 7 and 8, a clearance "k" somewhat larger than the thickness "t" of the open end 1*a* is formed between the chamfers 2*b* and 4*a*, as illustrated in FIG. 8(*b*).

Thereafter, the cam roller 45 is engaged with the inner cam face 17*b*, and the actual clearance "k" is equal to the thickness of the portion 1*a*' in the open end 1*a* under configuring, i.e. the flange portion 9, and somewhat larger than the set clearance "k", as indicated in FIGS. 8(*c*) and 8(*d*).

The gap between the curved chamfer 3*b* of the inner roll 3 and the curved chamfer 4*b* of the spinning roll 4 is increased with the advance of the spinning roll 4, since the inner roll 3 moves away axially from the spinning roll 4 with the advance.

Accordingly, the variation in the revolution velocity of the spinning roll 4 is small, and thus the slippage between the open end 1*a* and the spinning roll 4 is little, so that the outer lacquer film will scarcely be damaged or peeled.

While the cam roller 45 is engaged with the outer cam face 17*a*, the clearance "k" may be adjusted to be a little larger than the thickness "t" of the open end 1*a*, so that the flange portion 9 is formed without generating wrinkles with small number of revolutions, even when the open end 1*a* is relatively thin and hard. Thus the forming time may be shortened.

While the cam roller 45 is engaged with the inner cam face 17*b*, the portion 1*a*' of the open end 1*a* (FIG. 8(*c*)) on the chamfer 2*b* and the outer surface 2*a* is formed into the flange portion 9 and part of the necked-in portion 10 by the spinning roll 4 under pressure due to the springs 6. The pressure can be controlled to an adequate value by adjusting the set clearance "k" where the open end 1*a* is not present between the chamfers 2*b* and 4*b*, to be a little smaller than the thickness of the open end 1*a*.

Accordingly, the flange portion 9 and the part of the necked-in portion 10 may be formed without generating wrinkles. Further, by adjusting the set clearance "k" as above-mentioned, the spinning roll 4 may be prevented from coming into contact with the cam end holder 2 and damaging the tools, when the forming apparatus is run normally, but can bodies are not fed due to troubles of the can body feeder or the like.

Since throughout the forming operation the spinning roll 4 does not squeeze directly the portion 1*a*" of the open end 1*a* between the curved chamfers 3*b* and 4*b* against the inner roll 3, the necked-in portion 10 may not be reduced in thickness, nor ruptured.

As soon as the flange portion 9 and the necked-in portion 10 have been formed, the inner roll 3, the chuck 7 and the bottom support plate 57 dwell at a very short time (refer to FIG. 9(*b*), (*c*), (*d*)). During this time the spinning roll 4 retracts, i.e. moves away from the can end holder 2, and simultaneously the inner roll 3 is orbited to be coaxial with the can end holder 2 by means of the retracting ball screw assembly 29 (refer to FIG. 9(*a*), (*e*)).

Thereafter, the chuck 7 and the bottom support plate 57 retract rapidly to the position shown in FIG. 6, to move away the can body 1 from the inner roll 3 (refer to FIG. 9(*c*), (*d*)). Immediately the vacuum suction shaft 52 is released from vacuum, and the can body 1 is detached from the chuck 7 to be discharged for the subsequent production process (refer to FIG. 9(*a*)).

A test was conducted to investigate the relationship between the push depth and the number of revolutions per minute (r.p.m.) of the spinning roll 4 by using a forming test apparatus not shown equipped with the can end holder 2, the inner roll 3, the spinning roll 4, the spring 6 and the chuck 7 of the type as illustrated in FIG. 7.

The summary of the dimensions of the parts of the apparatus and the can body 1, and the operating conditions is as follows.

The diameters of the outer surface 2*a* of the can end holder 2, the inner roll 3 and the spinning roll 4 are 65.8 mm, 57 mm and 36 mm, respectively; the gap width between the can end holder 2 and the inner roll 3 prior to the forming is 1 mm; the height and the outer diameter of the can body 1 (made of tinplate) are 123 mm and 66.2 mm , respectively; the r.p.m. of the can body 1 is 100; the moving velocity of the inner roll 3 and the chuck 7 is 35 mm per minute; the advancing velocity of the spinning roll 4 is 20 mm per minute.

Figure 10:
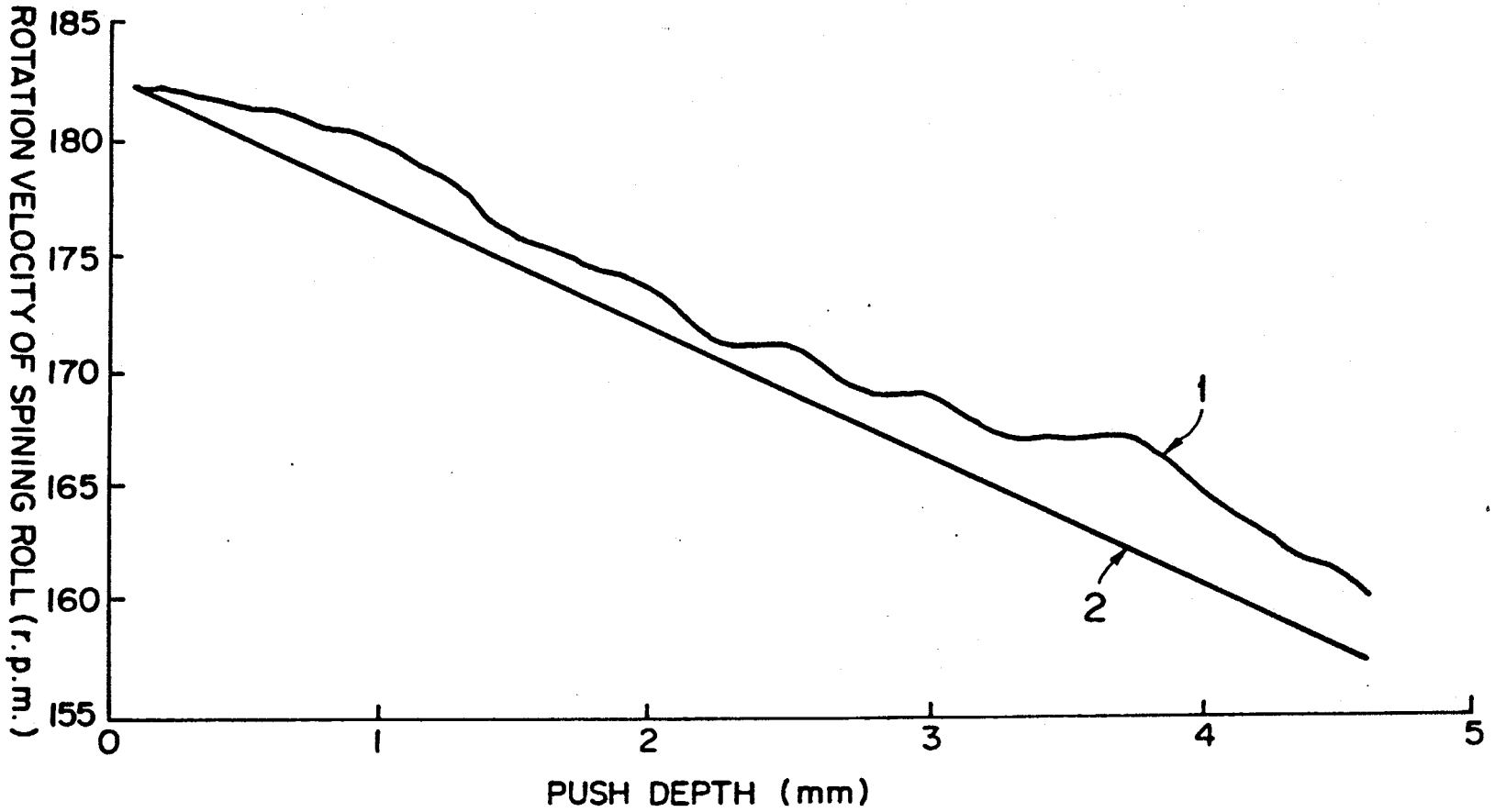
FIG. 10 is a diagram indicating the relationship between the depth to which the spinning roll is forced into the open end and the number of revolutions per minute of the can body in accordance with the invention.

The results are shown in FIG. 10, wherein curve 1 is a measured one and curve 2 is one determined by calculation based on the circumferential velocity of the narrowest portion of the necked-in portion 10. Both curves coincide substantially to each other, indicating that little slippage occurred.

In the test, so as to facilitate the measurement of the change in the r.p.m. of the spinning roll 4, the r.p.m. of the can body 1 and the moving velocities of the inner roll 3, the chuck 7 and the spinning roll 4 were set to about 1/20 of those in the commercial operations.

For comparison, a similar test was conducted except that an inner roll held axially stationary and a spinning roll resiliently biased toward the chuck by a spring in accordance with the prior art were employed.

Figure 11:
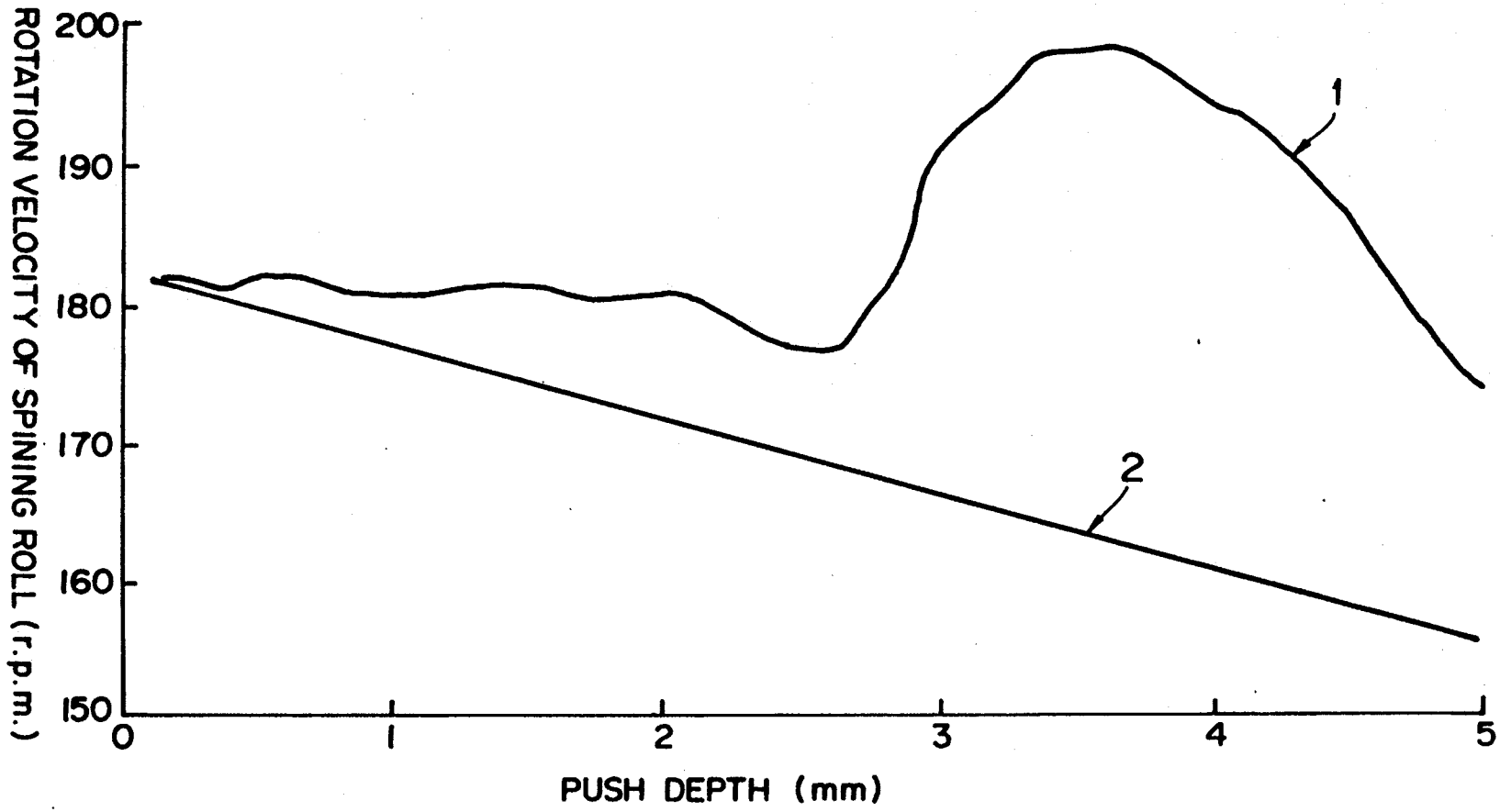
FIG. 11 is a diagram indicating the relationship between the depth to which the spinning roll is forced into the open end and the number of revolutions per minute of the can body in the case of a prior method.

The results are shown in FIG. 11, wherein curve 1 is a measured one and curve 2 is one calculated in the same manner as the curve 2 in FIG. 10. Both the curves are remarkably apart from each other particularly in the latter half of the forming operation, indicating a large slippage created during configuring.

The embodiments described and illustrated have been given by way of example only and it should be understood that the scope of the invention extends to those variations which will appear to those skilled in the art to which the invention relates.

What is claimed is:

1. A method of configuring a necked-in and flange portion in an open end of a can body by using a can end holder driven for rotation about its axis, a freely rotatable and axially movable inner roll of a reduced diameter disposed adjacent the can end holder which inner roll can be orbited to an eccentric position to make contact with the inner surface of the open end, and a spinning roll positioned axially stationary outside the can body and capable of substantially radial movement toward and away from the open end in a controlled mode relative to the axial movement of the inner roll, wherein while the can body with the open end telescoped onto the can end holder is rotated about its axis together with the can end holder, the spinning roll is advanced toward the can end holder and forced into the open end, and simultaneously the can body is moved in an axial direction away from the can end holder together with the inner roll at a controlled speed relative to an advancement of the spinning roll, to form the necked-in and flange portion in the open end.

2. A method of configuring a necked-in and flange portion according to claim 1 in which the open end is configured by forcing the spinning roll into the open end, simultaneously moving slightly the can end holder in an axial direction counter to the inner roll against a resilient force, while controlling a clearance between a truncated cone-shaped chamfer formed about a front rim of the can end holder and a truncated cone-shaped chamfer formed about a rear rim of the spinning roll.

3. A method of configuring a necked-in and flange portion according to claim 2 in which the clearance is controlled by a cam supported to be freely rotatable and axially stationary relative to the can end holder and a cam follower supported to be moved together with the spinning roll.

* * * * *